US007418919B2

(12) United States Patent
Smith et al.

(10) Patent No.: US 7,418,919 B2
(45) Date of Patent: Sep. 2, 2008

(54) FISHING BOAT BATHROOM PRIVACY SYSTEM

(76) Inventors: Charles M. Smith, 227 E. Fork Rd., Sunnyvale, TX (US) 75182; Kirk R. Smith, 227 E. Fork Rd., Sunnyvale, TX (US) 75182

( * ) Notice: Subject to any disclaimer, the term of this patent is extended or adjusted under 35 U.S.C. 154(b) by 0 days.

(21) Appl. No.: 11/588,026

(22) Filed: Oct. 26, 2006

(65) Prior Publication Data

US 2008/0098946 A1 May 1, 2008

(51) Int. Cl.
*B63B 17/00* (2006.01)

(52) U.S. Cl. ..... 114/361; 114/364

(58) Field of Classification Search ..... 114/361, 114/364; 135/96, 126
See application file for complete search history.

(56) References Cited

U.S. PATENT DOCUMENTS 1,538,311 A 5/1925 Anticknap
1,652,581 A 12/1927 Roberts
3,899,168 A * 8/1975 Besherse ..... 472/75
3,960,161 A 6/1976 Norman
4,716,918 A 1/1988 Hayashida et al.
4,815,784 A 3/1989 Zheng
4,858,634 A 8/1989 McLeese
D341,407 S 11/1993 McLeese
RE35,571 E 7/1997 McLeese
5,816,279 A * 10/1998 Zheng ..... 135/126
6,378,142 B1 * 4/2002 Gray ..... 4/449
6,672,323 B2 1/2004 Gupta et al.
7,137,399 B1 * 11/2006 Ransom et al. ..... 135/128
2006/0064818 A1 * 3/2006 Danaher ..... 5/414

* cited by examiner

*Primary Examiner*—Stephen Avila
(74) *Attorney, Agent, or Firm*—Cash Klemchuk Powers Taylor LLP; Darin M. Klemchuk; Keith E. Taber

(57) ABSTRACT

A privacy screen for use on a bass boat to cover the cockpit area for use as a toilet.

6 Claims, 6 Drawing Sheets

FISHING BOAT BATHROOM PRIVACY SYSTEM

BACKGROUND

1. Field of the Invention

The present invention relates generally to privacy screens and in particular to privacy screens for use on fishing boats.

2. Description of Related Art

Within the sport fishing industry, and in particular within the bass boat market, there is scant provision for the execution of bodily waste functions in privacy.

While those who spend considerable time fishing may be able to adapt to the need to withhold from such bodily functions while fishing, those who enjoy the sport less often are typically less able to do so. Also, there are times when, due to diet or malicious infection, the body is not cooperative with any efforts to take care of such needs while out on a boat.

Currently, such problems will either cut a fishing trip short or result in trespassing on lands adjacent the fishing area or unintended public nudity on the water. Neither is a satisfactory result.

Further exacerbating the above problem are several factors. First, the growth of women participants in fishing has highlighted this somewhat unspoken problem. Second, the growth in the popularity of competitive fishing as a spectator sport has made it harder for competitive fishers to find a bit of privacy. Third, the growth of residential development in fishing areas has made it harder for all fishers to find a private place to relieve themselves.

Of course, the reason bass boats do not have a private head is that the boat is designed as a floating platform to be fished from that is also maneuverable enough to quickly move from one spot to another across a large body of water and be positioned in relatively shallow water. Therefore, the boat has a very low profile and relatively flat decking to maximize the goal of providing a very maneuverable fishing platform. This leaves no room for a built-in private head, as may be found on other, larger boats.

A need exists, therefore, for a privacy screen that allows a fisherman and passengers the privacy needed to execute bodily waste functions without reducing the utility of the fishing boat by changing the profile of the boat or adding burdensome weight to the boat.

All references cited herein are incorporated by reference to the maximum extent allowable by law. To the extent a reference may not be fully incorporated herein, it is incorporated by reference for background purposes and indicative of the knowledge of one of ordinary skill in the art.

BRIEF SUMMARY OF THE INVENTION

The problems presented in bass boats of the current design with respect to privacy are solved by the systems and methods of the present invention. In accordance with one embodiment of the present invention, a portable privacy screen is provided.

The privacy system has a privacy screen which includes a hoop frame and cover, without floor, and is easily attached to the pull rings of the storage compartments of a bass boat.

Other objects, features, and advantages of the present invention will become apparent with reference to the drawings and detailed description that follow.

DETAILED DESCRIPTION OF THE PREFERRED EMBODIMENT

All references cited herein are incorporated by reference to the maximum extent allowable by law. To the extent a reference may not be fully incorporated herein, it is incorporated by reference for background purposes and indicative of the knowledge of one of ordinary skill in the art.

In the following detailed description of the preferred embodiments, reference is made to the accompanying drawings which form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical mechanical and electrical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
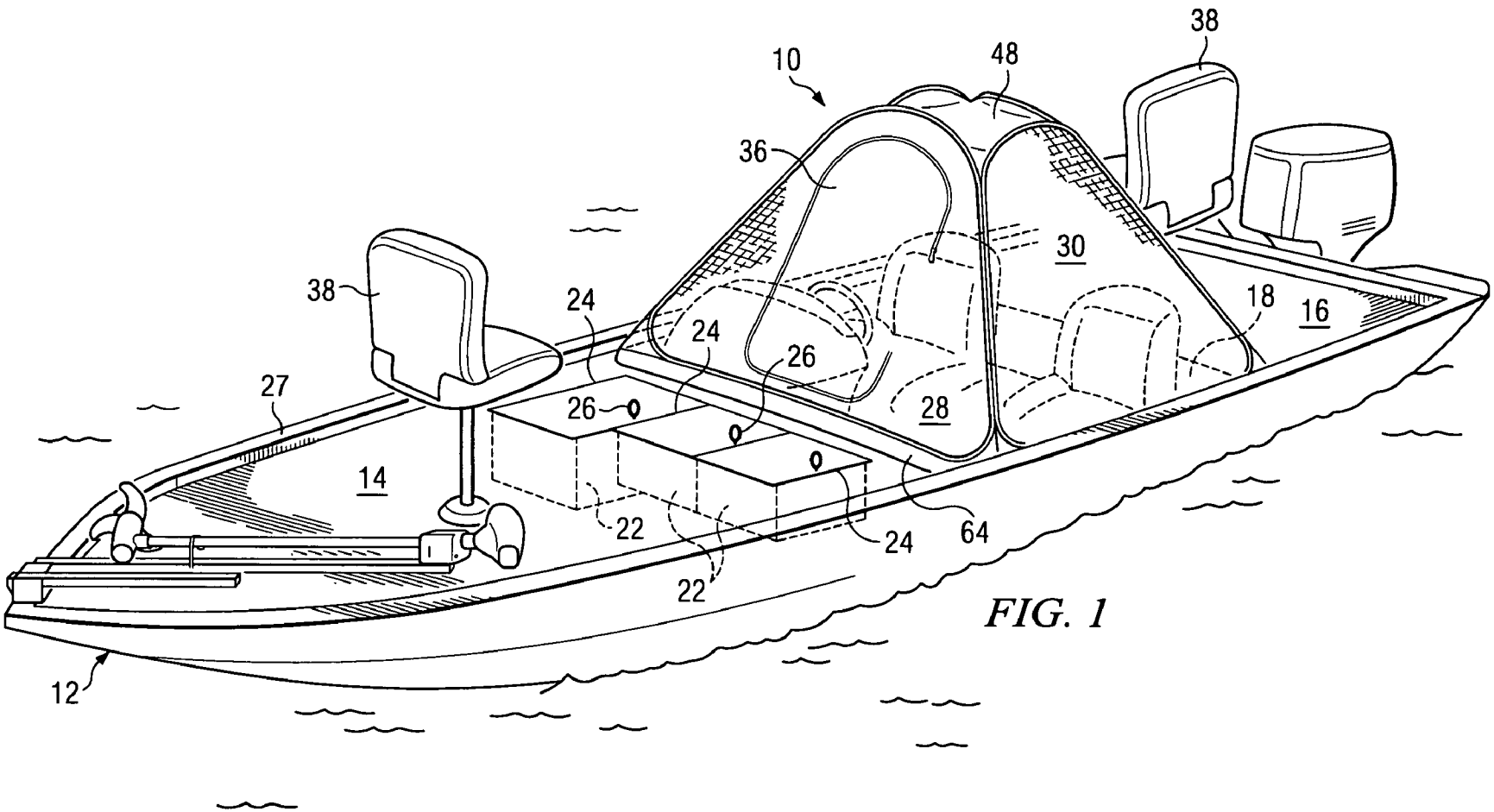
FIG. 1 is an overview of a privacy system mounted on a bass boat.

FIG. 1 is an overview of a privacy system 8 including a privacy screen 10 mounted on a bass boat 12 showing the environment in which the privacy screen 10 is designed to be used. The bass boat 12 has a front deck 14 and a rear deck 16 separated by a cockpit 18, the cockpit 18 being covered by the privacy screen 10 in this view. Cock pit 18 typically has a floor that is about 15 inches lower than the level of both the front deck 14 and the rear deck 16, although that distance may vary on different models of bass boats 12. Cockpit 18 will typically have two seats 20 with a space between the seats wide enough to allow passage from the front deck 14 to the rear deck 16 through cockpit 18 and vice versa.

Both front deck 14 and rear deck 16 typically have assorted storage compartments 22. The lids 24 of storage compartments 22 form a part of each of the front deck 14 and rear deck 16. Each lid 24 has at least one pull ring 26. Pull rings 26 are typically of a locking variant that allows the ring to be rotated from a locked position to an unlocked position and vice versa. When a locking pull ring 26 is in an unlocked position the lid 24 of a compartment 22 may be opened by pulling up on pull ring 26. When pull ring 26 is in a locked position lid 24 will not open even with a pull on pull ring 26.

Also visible in FIG. 1 is the side rail 27 of bass boat 12. Side rail 28 runs about the perimeter of the boat defining the boundary of front deck 14, rear deck 16 and cockpit 18. Side rail 18 is slightly above both front deck 14 and rear deck 16.

FIG. 1 also shows the position of privacy screen 10 on boat 12. Privacy screen 10 has a front panel 28 facing the bow of boat 12, side panels 30 each facing the port and starboard of boat 12, and a rear panel 32 facing the stem of boat 12. Privacy screen 10 is sized to cover cockpit 18 and provide a private area within cockpit 18 for the placement of a portable toilet 34 in an area slightly forward of and between seats 20. Toilet 34 is portable and may be moved as necessary, but will have the most room if placed in an area that is between the rear edge of the front deck 14 and the front edge of the seats 20. As will be more clearly shown below, both front panel 28 and rear panel 32 have doors 36 to allow for passage from front deck 14 to rear deck 16 through cockpit 18 without removal of privacy screen 10.

Also clear from FIG. 1 is the low height of privacy screen 10 relative to fishing seats 38 on the front deck 14 and rear deck 16. Fishing seats 38 are higher than a typical chair, but clearly privacy screen does not extend far above seats 18. The privacy screen 10 shown is only about 45 inches in height. This height, combined with the depth of the cockpit 18, about 15 inches, provides headroom of about 60 inches in the cockpit 18 when the privacy screen 10 is erected. To provide this amount of headroom in any other way would severely limit the functionality of the boat 12 while the privacy screen 10 was erected and would require dismantling the privacy screen between bodily functions. This would limit the utility of the privacy screen in those rare instances where a malicious bug or intestinal infection may require frequent use of the privacy screen 10.

Figure 2:
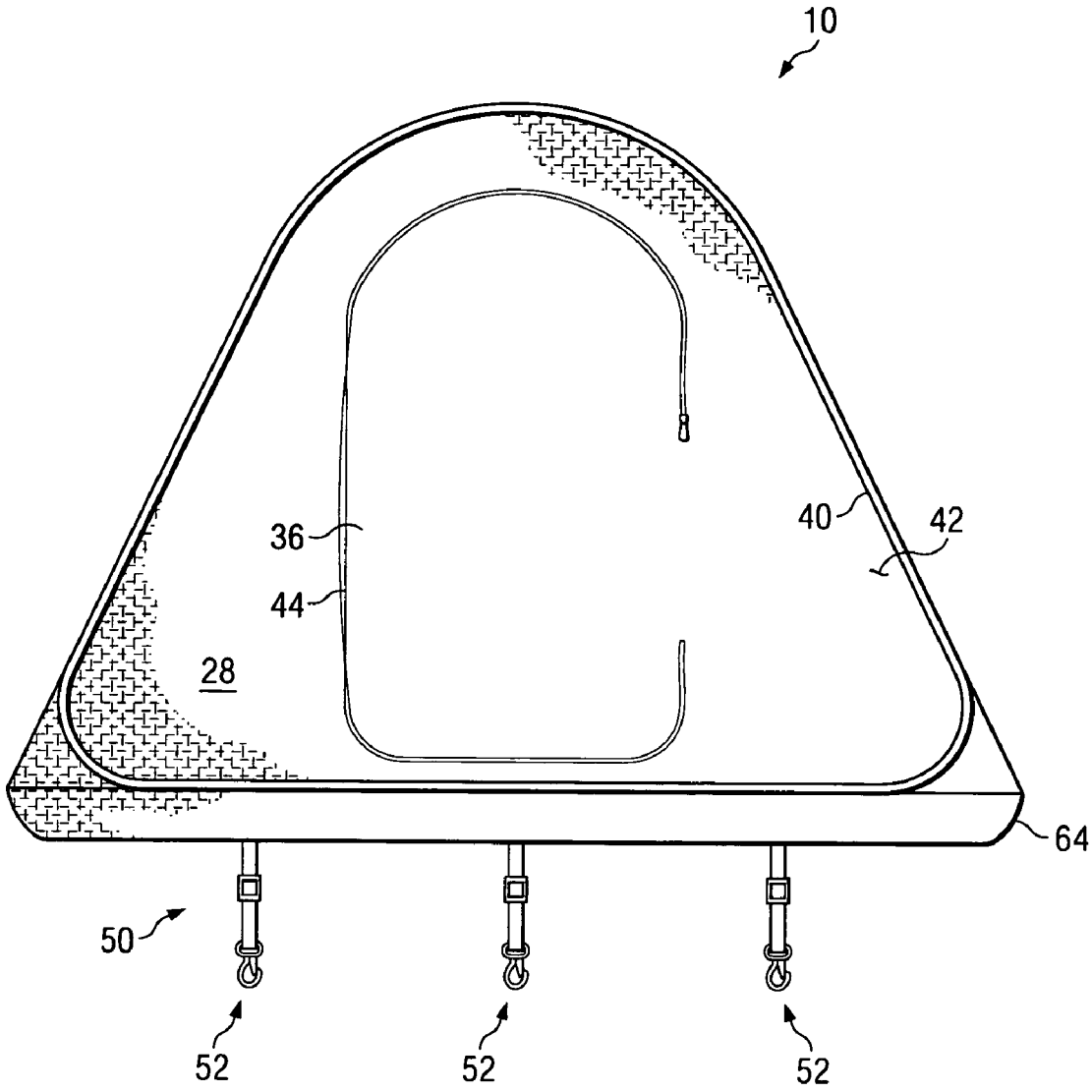
FIG. 2 is a view of the front panel of a privacy screen of the privacy system.

FIG. 2 is a view of the front panel 28 of a privacy screen 10. A semi-rigid hoop 40 defines the perimeter of front panel 28 while a light-weight fabric attached to the hoop creates the surface 42 of the panel 28. Zipper 44 creates a door 36 in the surface 42, although another closure means could be used, such as hook-in-loop closures, snaps or even buttons. Rear panel 32 has the same shape and features, including door 36.

Figure 3:
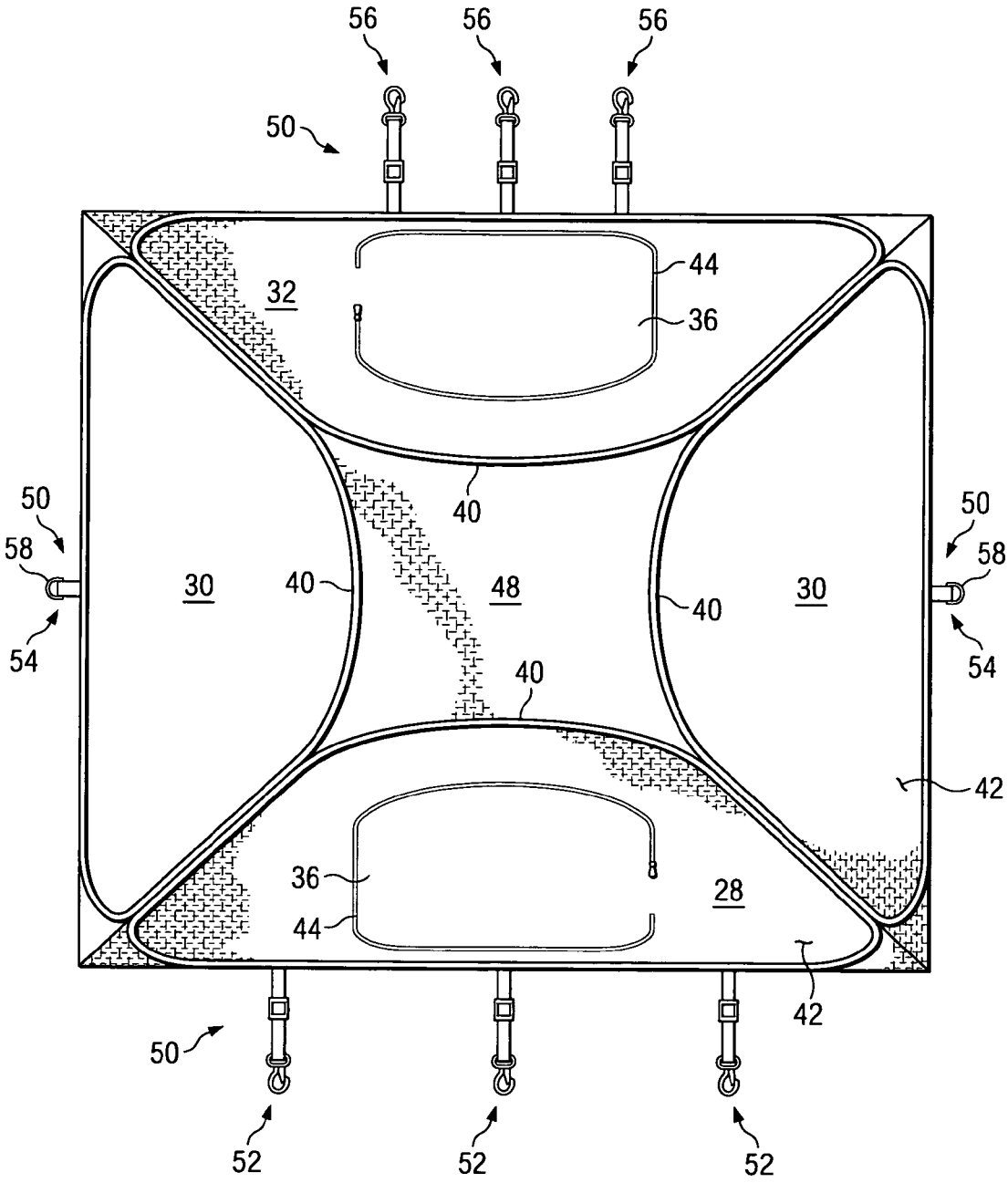
FIG. 3 is a top view of the privacy screen of the privacy system.

FIG. 3 is a top view of the privacy screen 10. From this view the front panel 28, side panels 30 and rear panel 32 can all be seen with their corresponding semi rigid hoops 40. The panels 28, 30, 32 intersect along edges and create an area on top that is covered by a top panel 48. Because privacy screen 10 is not a shelter from the elements, but is primarily a shelter of views, panels 28, 20, 32 may be made of any material suitable to block the view into the cockpit 18. Typical tent material, such as nylon weaves, is well suited to this use. Top panel 48 may be made of the same material or even lighter material as desired. Even a mesh material may be used for top panel 48 to promote ventilation.

Also shown on FIG. 3 are the attachment points 50 along the bottom of privacy screen 10. The loop construction of privacy screen 10 is self supporting, but attachment to boat 12 is necessary to prevent privacy screen 10 form blowing off boat 12. Also, privacy screen 10 may be custom made to fit a particular boat 12 or may be made with multiple attachment points 50 designed to fit a selection of boats 12. The privacy screen 10 of FIG. 3 is designed to fit a variety of boats 12 and therefore has multiple front tie downs 52 and rear tie downs 56, along with side tie downs 54. Side tie downs 54 are typically "D" rings 58 attached to the bottom edge of side panels 30 near the midpoint of the bottom edge. The "D" rings 58 may be secured to a variety of points within the cockpit 18, such as the throttle lever, grab handles, and seats, by strapping or elastic cords. Front tie downs 52 and rear tie downs 56 are typically snap hooks 60 attached to adjustable nylon webbing straps 62. Snap hooks 60 are attached to pull rings 26 on the front deck 14 and rear deck 16. The spacing of front tie downs 52 and rear tie downs 56 as shown is designed to maximize the number of boats 12 that the privacy screen 10 can be used with, based on the placement of pull rings 26 on the front deck 14 and rear deck 16 of the boats 12.

In normal use, only two attachment points 50 may be needed, but additional attachment points 50 are desired in higher winds to prevent the toppling of privacy screen 10.

Figure 4:
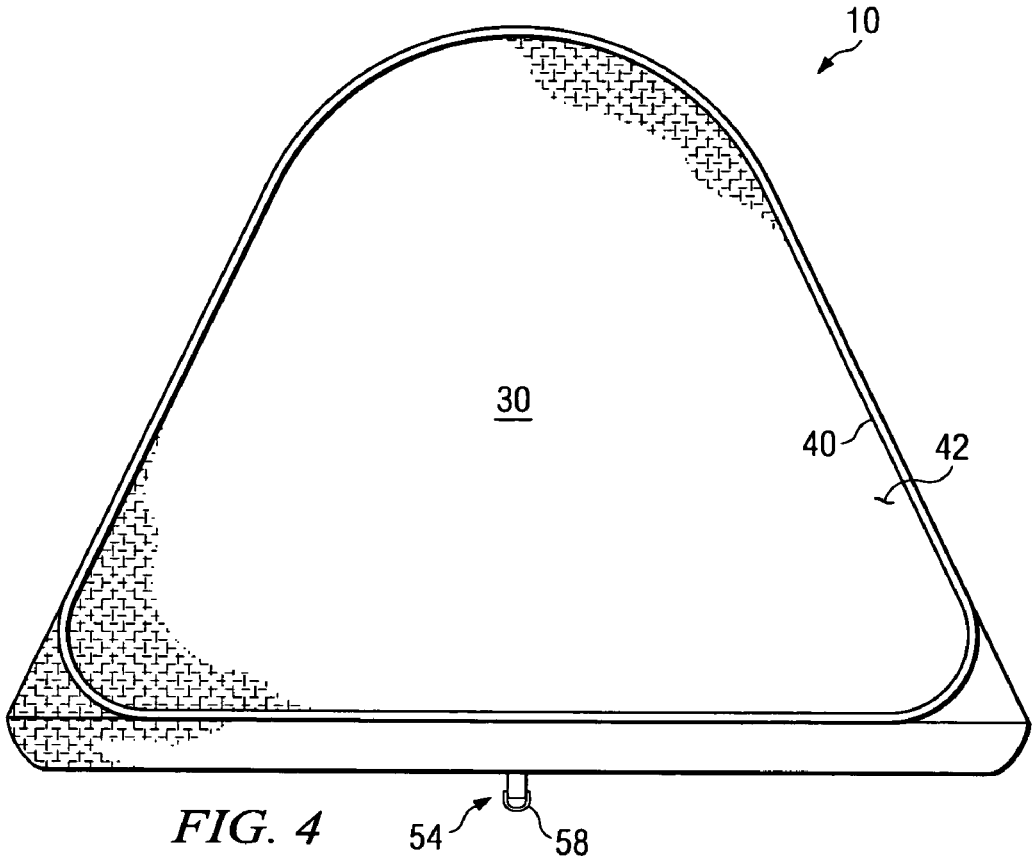
FIG. 4 is an angled view of a side panel and inside of a privacy screen of the privacy system.

FIG. 4 is an angled view of a side panel 30 and inside of a privacy screen 10 of the privacy system 8. As discussed above, privacy screen 10 is made of a semi-rigid hoop 40 defining a surface. Side panel 30 is the same on both the starboard and port sides of the privacy screen shown. Skirt 64 is visible around the bottom edge of screen 10, highlighting that screen 10 has no "floor" as a tent might.

Figure 5:
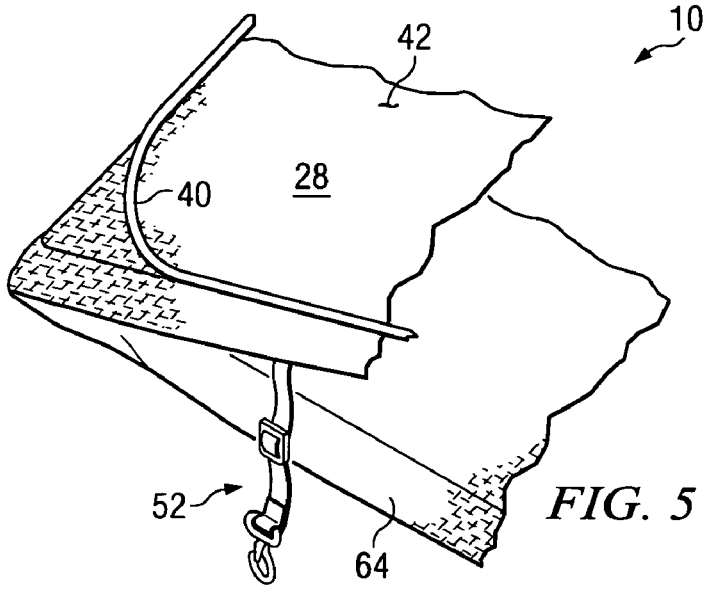
FIG. 5 is a detail view of the corner of a privacy screen of the privacy system.

FIG. 5 is a detail view of the corner of a privacy screen 10 showing skirt 64. Skirt 64 extends from the bottom of panels 28, 30, 32 to provide additional coverage where privacy screen 10 does not sit flush with front deck 14 and rear deck 16. As mentioned above, side rail 27 is slightly above decks 14, 16 such that if privacy screen 10 is resting atop side rail 27 there will be a gap between decks 14,16 and privacy screen 10. Therefore skirt 64 eliminates any gaps along the bottom of privacy screen 10.

Figure 6:
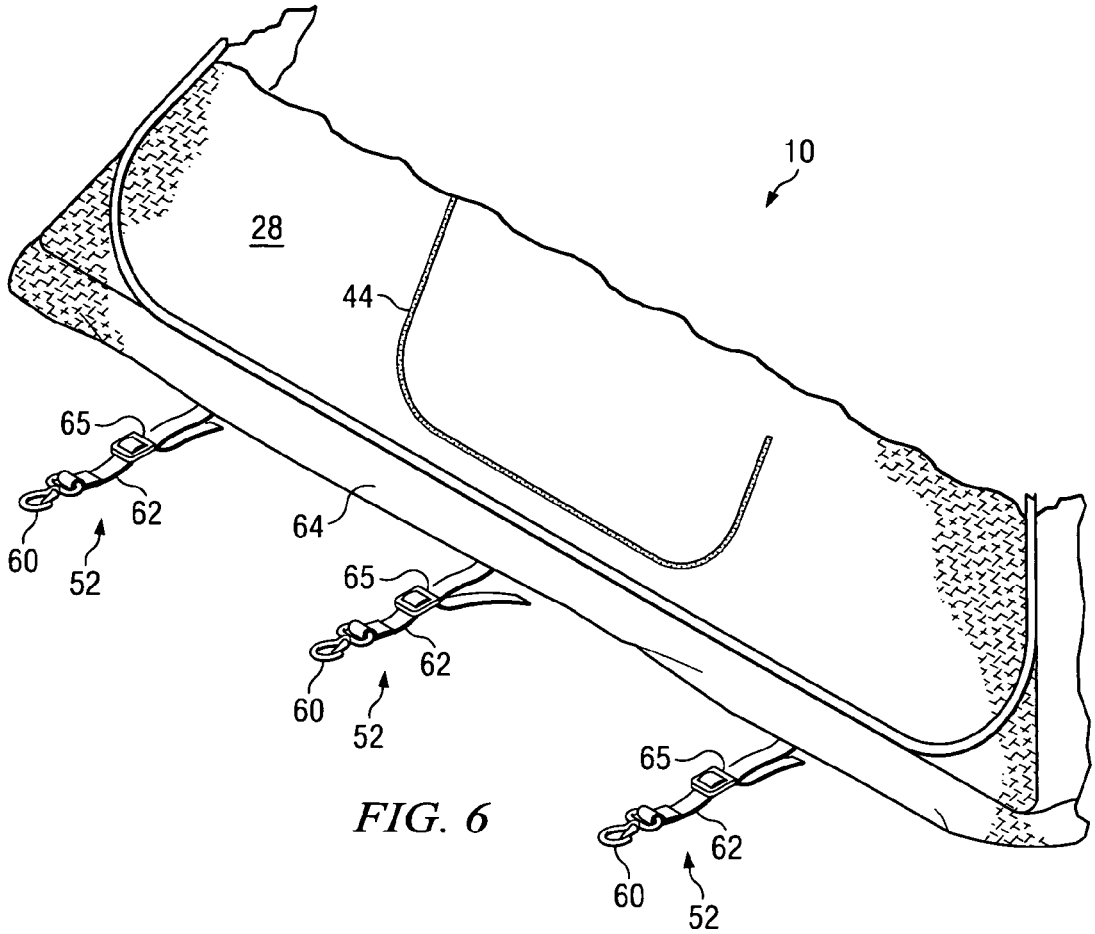
FIG. 6 is a detail view of the front tie downs of a privacy screen of the privacy system.

FIG. 6 is a detail view of the front tie downs 52 of a privacy screen 10. The snap hooks 60 are attached to adjustable nylon webbing straps 62, made adjustable through the use of adjustable buckles 65.

Figure 7:
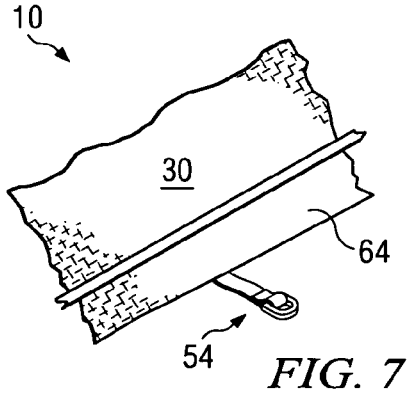
FIG. 7 is a detail view of the side tie connections of a privacy screen of the privacy system.

FIG. 7 is a detail view of the side tie downs 54 of a privacy screen 10. Side tie downs 54 are shown as "D" rings to the bottom of side panels 30. Also shown is skirt 64.

Figure 8:
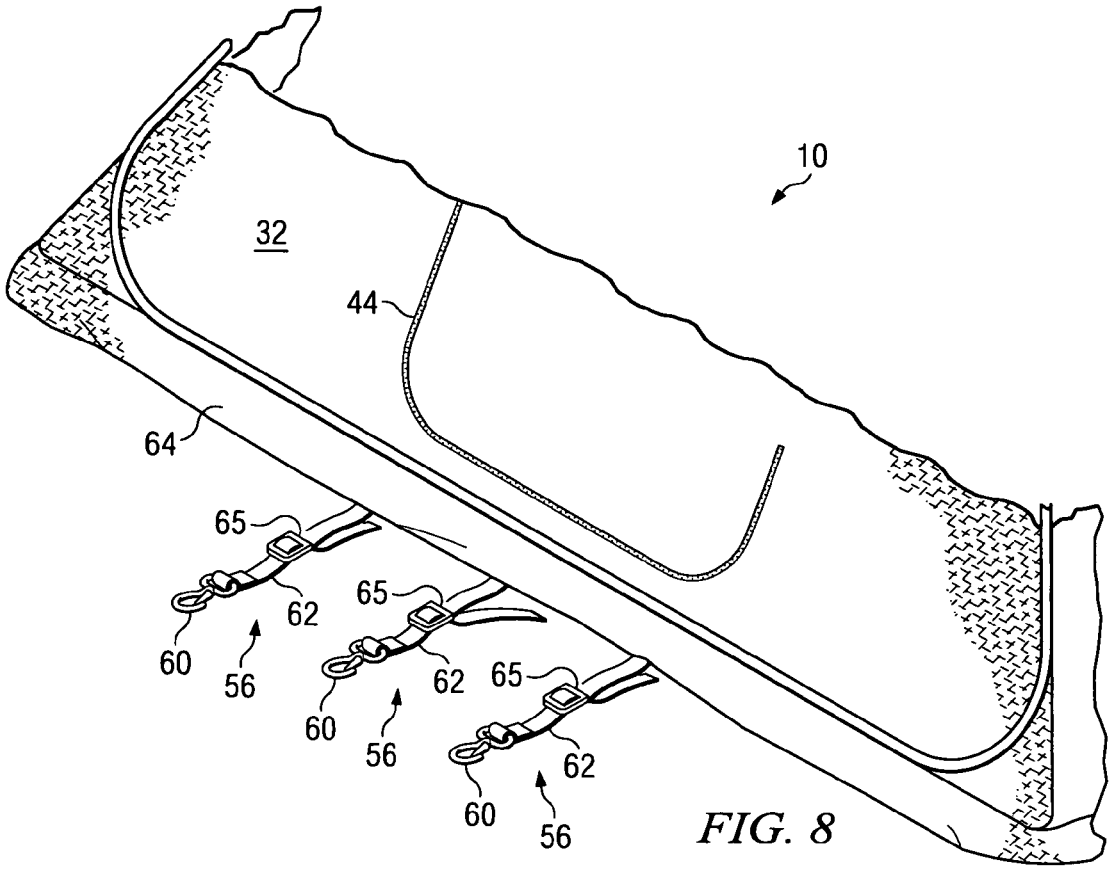
FIG. 8 is a detail view of the rear tie downs of a privacy screen of the privacy system.

FIG. 8 is a detail view of the rear tie downs 56 of a privacy screen 10. The snap hooks 60 are attached to adjustable nylon webbing straps 62, made adjustable through the use of adjustable buckles 65.

Figure 9:
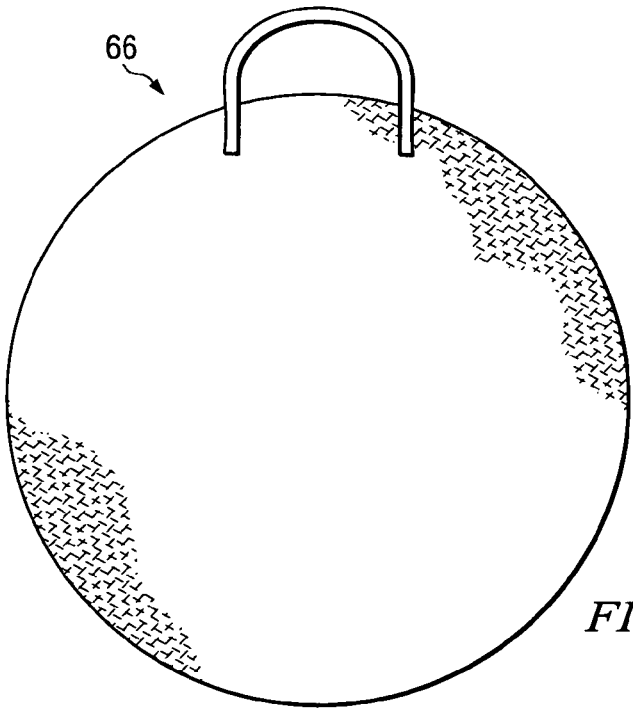
FIG. 9 is a schematic view of a tote bag for a privacy screen of the privacy system.

FIG. 9 is a schematic view of a tote bag 66 for a privacy screen 10. The semi-rigid hoop construction of privacy screen 10 is easily folded into a compact round tote bag for transportation and storage.

The primary advantage of the present invention is the provision of a simple privacy structure that does not interfere with the primary functions of the bass boat.

Even though the examples discussed herein are applications of the present invention in bass boats the present invention also can be applied to other types of boats that do not have private toilets, including but not limited to other fishing and recreational boats. Furthermore, the example shown is thought to fit up to 90% of bass boats currently in use, but some boats may not use locking pull rings. In such boats without locking pull rings the screen may be attached to other portions of the boat, such as other fixed points of the boat or adhesive anchors that may be applied to surfaces of the boat. Such adhesive anchors may take the form of hook and loop fasteners or rings that can attach to corresponding tie downs.

It should be apparent from the foregoing that an invention having significant advantages has been provided. While the invention is shown in only a few of its forms, it is not just limited but is susceptible to various changes and modifications without departing from the spirit thereof. Such modifications could include the use of water repellant materials, for example.

We claim:

1. A privacy screen for use on a fishing boat comprising:

a hoop frame having semi-rigid hoops supporting the privacy screen;

a cover attached the hoop frame;

the hoop frame forms four panels, a front panel, a rear panel, and two side panels that form a pyramidal shape without a bottom such that placing the privacy screen over a recessed cockpit area of the fishing boat provides a larger volume within the privacy screen than would be available if placed on a flat surface;

a first plurality of attachment straps are positioned along a lower edge of the front panel to be aligned with pull rings of storage compartments on a front deck of specific boat models;

a second plurality of attachment straps are positioned along a lower edge of the rear panel to be aligned with pull rings of storage compartments on rear decks of specific boat models;

at least one attachment strap positioned along a lower edge of each side panel to secure the side panel;

the privacy screen thereby being adapted for placement over the cockpit of the fishing boat and attachable to the fishing boat by the attachment straps; and both the front panel and the rear panel have doors that open and close to provide privacy as well as access to and passage through the privacy screen.

2. The privacy screen according to claim 1 wherein:

a skirt depends from a lower edge of the panels surrounding an open bottom of the privacy screen.

3. The privacy screen according to claim 2 wherein:

the skirt is made of the same material as the privacy screen.

4. A toilet system comprising:

a fishing boat having a front deck, a rear deck, and a cockpit area between the decks, the cockpit area being recessed lower than the front deck and rear deck and having a passage space between two seats and the decks having pull rings in lids of compartments;

a portable toilet sized to fit between the two seats in the passage space forward of the two seats;

a privacy screen adapted to fit over the cockpit area and attach to the pull rings, the privacy screen comprising:

a hoop frame having semi-rigid hoops supporting the privacy screen;

a cover attached the frame;

the hoop frame forms four panels, a front panel, a rear panel, and two side panels that form a pyramidal shape without a bottom such that the recessed floor of the cockpit area adds to the volume enclosed by the privacy screen;

a first plurality of attachment straps are positioned along a lower edge of the front panel to be aligned with the pull rings on the front deck;

a second plurality of attachment straps are positioned along a lower edge of the rear panel to be aligned with the pull rings on the rear deck;

at least one attachment strap positioned along a lower edge of each side panel to secure the side panel;

the privacy screen thereby being adapted for placement over the cockpit area and attachable to the fishing boat by the attachment straps; and both the front panel and the rear panel have doors that open and close to provide privacy as well as access to and passage through the privacy screen.

5. The toilet system according to claim 4 wherein:

a skirt depends from a lower edge of the panels towards the decks and gunwales of the boat surrounding an open bottom of the screen.

6. The toilet system according to claim 5 wherein:

the skirt is made of the same material as the screen.

* * * * *